US006368968B1

(12) United States Patent
Hsu

(10) Patent No.: US 6,368,968 B1
(45) Date of Patent: Apr. 9, 2002

(54) DITCH TYPE FLOATING RING FOR CHEMICAL MECHANICAL POLISHING

(75) Inventor: Wei-Chieh Hsu, Hsinchu (TW)

(73) Assignee: Vanguard International Semiconductor Corporation, Hsin-chu (TW)

( * ) Notice: Subject to any disclaimer, the term of this patent is extended or adjusted under 35 U.S.C. 154(b) by 0 days.

(21) Appl. No.: 09/547,236

(22) Filed: Apr. 11, 2000

(51) Int. Cl.[7] ..... H01L 21/302

(52) U.S. Cl. ..... 438/689; 438/691; 438/692; 438/693; 438/700

(58) Field of Search ..... 438/689, 691, 438/692, 693, 700

(56) References Cited

U.S. PATENT DOCUMENTS

| | | | | | |
|---|---|---|---|---|---|
| 5,687,036 | A | * | 11/1997 | Kassab | 360/31 |
| 5,721,816 | A | * | 2/1998 | Kusbel et al. | 360/53 |
| 5,774,285 | A | * | 6/1998 | Kassab et al. | 360/25 |
| 5,964,653 | A | * | 10/1999 | Perlov et al. | 451/285 |
| 5,993,302 | A | * | 11/1999 | Chen et al. | 451/258 |
| 6,013,147 | A | * | 1/2000 | Byerley | 156/110.1 |
| 6,059,638 | A | * | 5/2000 | Crevasse et al. | 451/288 |
| 6,159,083 | A | * | 12/2000 | Appel et al. | 451/289 |
| 6,224,506 | B1 | * | 5/2001 | Peeters et al. | 192/3.54 |
| 6,282,049 | B1 | * | 8/2001 | Cameron et al. | 360/75 |

* cited by examiner

*Primary Examiner*—Benjamin L. Utech
*Assistant Examiner*—Vanessa Perez-Ramos
(74) *Attorney, Agent, or Firm*—George O. Saile; Stephen B. Ackerman

(57) ABSTRACT

An apparatus for polishing a semiconductor wafer comprising a rotatable polishing platen having an upper surface, a polishing pad fixedly attached to the upper surface, a polishing slurry containing a mechanical abrasive deposited on the upper surface of the polishing pad. Mounted above the polishing pad is a rotatable polishing head assembly having a shallow recessed face adapted to centrally hold the upper back surface of the substrate, the recessed face is oriented substantially parallel to the upper surface of the polishing platen. The rotatable polishing head assembly has its rotatable axis offset relative to the rotatable axis of the polishing platen. A non-rotary cylindrical actuator assembly is coaxially oriented about the outer edge of the rotatable polishing head assembly with a ditched ring removably attached to the bottom surface of the cylindrical actuator assembly. The ditched ring also has a bottom section of a reduced wall thickness of approximately 5 mm. A multiplicity of conduit grooves are formed in the bottom section of the ditched ring that allows a boundary layer of abrasive slurry to travel unimpeded to the rotating semiconductor wafer. The reduced wall thickness at the bottom of the ditched ring is configured to displace wrinkles from the outer edge of the wafer to the outer periphery of the ditched ring. This solves the edge exclusion problem, while the concentric conduit grooves allow unimpeded tracks of abrasive slurry to uniformly remove microscratches from the planarized surface of the wafer

7 Claims, 10 Drawing Sheets

FIG. 1 – Prior Art

FIG. 2 – Prior Art

FIG. 3 – Prior Art

FIG. 4 – Prior Art

DITCH TYPE FLOATING RING FOR CHEMICAL MECHANICAL POLISHING

BACKGROUND OF THE INVENTION (1) Technical Field

This invention relates to the polishing of semiconductor wafers of the type from which chips for integrated circuits and the like are made. More specifically in a chemical mechanical polishing (CMP) process in which a wafer is held by a tooling polishing head and is polished by contact with an abrasive material dispensed on a rotating polishing pad.

(2) Description of the Prior Art

The fabrication of integrated circuits on a semiconductor wafer involves a number of steps where patterns are transferred from photolithographic photomasks onto the wafer. The photomasking processing steps opens selected areas to be exposed on the wafer for subsequent processes such as inclusion of impurities, oxidation, or etching.

During the forming of integrated circuit structures, it has become increasingly important to provide structures having multiple metallization layers due to the continuing miniaturization of the circuit elements in the structure. Each of the metal layers is typically separated from another metal layer by an insulation layer, such as an oxide layer. To enhance the quality of an overlying metallization layer, one without discontinuities of other blemishes, it is imperative to provide an underlying surface for the metallization layer that is ideally planar.

Conventionally, during the fabrication of integrated circuit structures, planarizing of the overlying metallization layers is accomplished by CMP. The uniform removal of material from and the planarity of patterned and unpatterned wafers is critical to wafer process yield. Generally, the wafer to be polished is mounted on a tooling head which holds the wafer using a combination of vacuum suction or other means to contact the rear side of the wafer and a retaining lip or ring around the edge of the wafer to keep the wafer centered on the tooling head. The front side of the wafer, the side to be polished, is then contacted with an abrasive material such as a polishing pad or abrasive strip. The polishing pad or strip may have free abrasive fluid sprayed on it, may have abrasive particles affixed to it, or may have abrasive particles sprinkled on it.

The ideal wafer polishing process depends on several factors which includes; relative velocity and applied pressure between the wafer and the polishing pad, polishing pad roughness and pad elasticity, surface chemistry, abrasion effects, and contact area. As a result, the ideal CMP process should have constant cutting velocity over the entire wafer surface, sufficient pad elasticity, and a constant supply of polishing slurry. Additionally, control over the temperature and pH is critical and the direction of the relative pad/wafer velocity should be randomly distributed over the entire wafer surface.

Most current CMP machines fail to produce constant velocity distribution over the entire wafer surface which is necessary for uniform material removal and good flatness. A common type, shown in simplified form in FIG. 1, a wafer 10 is held by a tooling head 21 which rotates about the axis of the wafer 10. A large circular polishing pad 13 is rotated while contacting the rotating wafer being held by the tooling head. The rotating wafer contacts the larger rotating polishing pad in an area away from the center of the polishing pad. Thus, the relative motion between the wafer and the polishing pad has two components; one due to the rotating wafer and another due to the rotating polishing pad.

A major disadvantage with prior systems was related to the fact that a wafer moving in a particular direction would have a lower removal rate at its leading edge because of what is commonly referred to as "edge exclusion" caused by a ripple formed in the polishing pad 13 when applied pressure between the wafer and the polishing pad is made, refer to FIG. 2. Prior art systems which provide only certain polishing patterns can not be easily made to control the removal rates at the edges due to this effect. As shown in FIG. 2, the ripple formed on the surface of the polishing pad, during contact with the wafer excludes this leading edge segment from contact with the polishing pad, hence, becomes the major contributing factor for edge exclusion. To avoid this problem, see FIG. 3, a fixed floating ring 17 peripherally oriented about the outer edge of the tooling head 21, and fixedly mounted to the tooling head driver housing 18, was developed to displace the ripple in the polishing pad outwardly from the leading edge of the wafer to the leading edge of the fixed floating ring. The addition of the fixed floating ring reduced the effects of edge exclusion, however, its implementation tended to push away the polishing slurry, thereupon, lengthening the polishing cycle.

The primary challenge is to make the oxide removal rate constant across the top surface of the larger diameter wafers, as well as maintaining a constant oxide removal rate during successive wafer runs. Prior polishing techniques do not provide trouble free process control for producing device patterns. The oxide removal rate is not constant between wafers thereby reducing device yield during the fabrication process.

SUMMARY OF THE INVENTION

It is therefore a primary object of the present invention to provide a polishing device that can improve the uniformity and planarity of the surface of a wafer being polished by eliminating edge exclusion caused by a ripple occurring on the surface of the polishing pad, and by permitting a more constant availability of polishing slurry as a function of radial distance of the wafer's contact position on the polishing pad.

According to one aspect of the present invention, there is provided in a polishing device including a rotatable polishing platen having an upper surface on which a polishing pad is attached, a rotatable wafer polishing head assembly having a lower surface opposed to an upper surface of the polishing pad on the polishing plate, for holding a wafer to be polished on the lower surface and pressurizing means for applying a polishing pressure to the rotatable wafer polishing head assembly, whereby the wafer held by the polishing head assembly is rotatably pressed against the rotating upper surface of the polishing pad under the polishing pressure applied from the pressurizing means to perform polishing of the wafer, the improvement wherein the rotatable wafer polishing head assembly is created with a floatable ditch type ring that is coaxial to, yet non-rotating, relative to the rotatable wafer polishing head assembly. The floatable ditch type ring is pneumatically and mechanically urged onto the rotating upper surface of the polishing pad.

It is an object of the present invention to provide a novel process and apparatus for CMP planarization by displacing the ripple on the polishing pad that causes edge exclusion during CMP planarization.

It is another object of the present invention to provide the method and apparatus to enhance the flow of slurry as a function of radial distance of the wafer relative to the rotating polishing plate.

It is still another object of the present invention to provide the method capable of high yield in fabricating a semiconductor device.

It is an additional object of the present invention to provide the method and apparatus useful in a semiconductor device having large scale integration formed on large diameter wafers.

These and further constructional and operational characteristics of the invention will be more evident from the detailed description given hereafter with reference to the figures of the accompanying drawings which illustrate preferred embodiments and alternatives by way of non-limiting examples.

DETAILED DESCRIPTION OF THE PREFERRED EMBODIMENT

Figure 1:
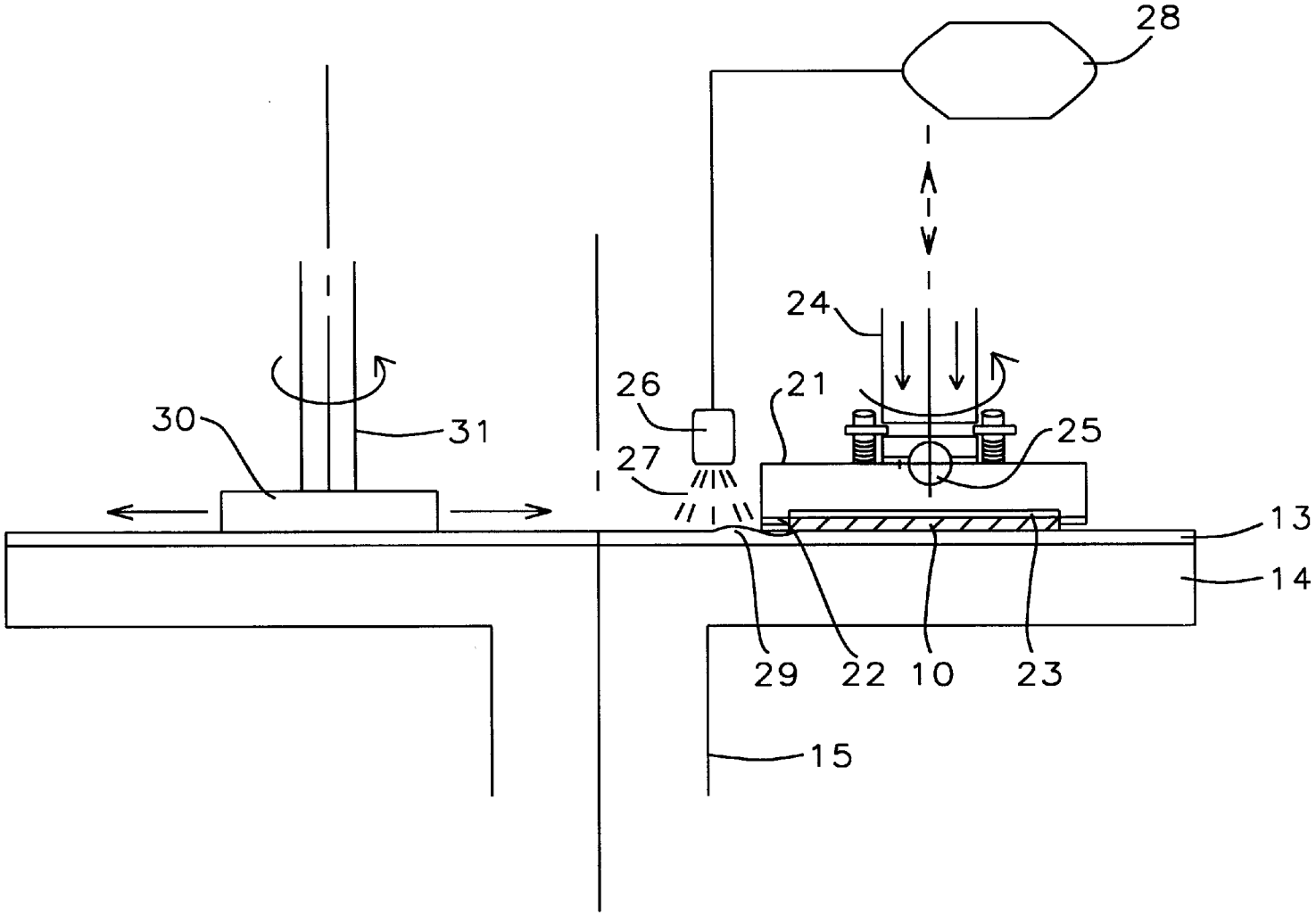
FIG. 1 is a schematic front view of a CMP apparatus according to the prior art.
Figure 2:
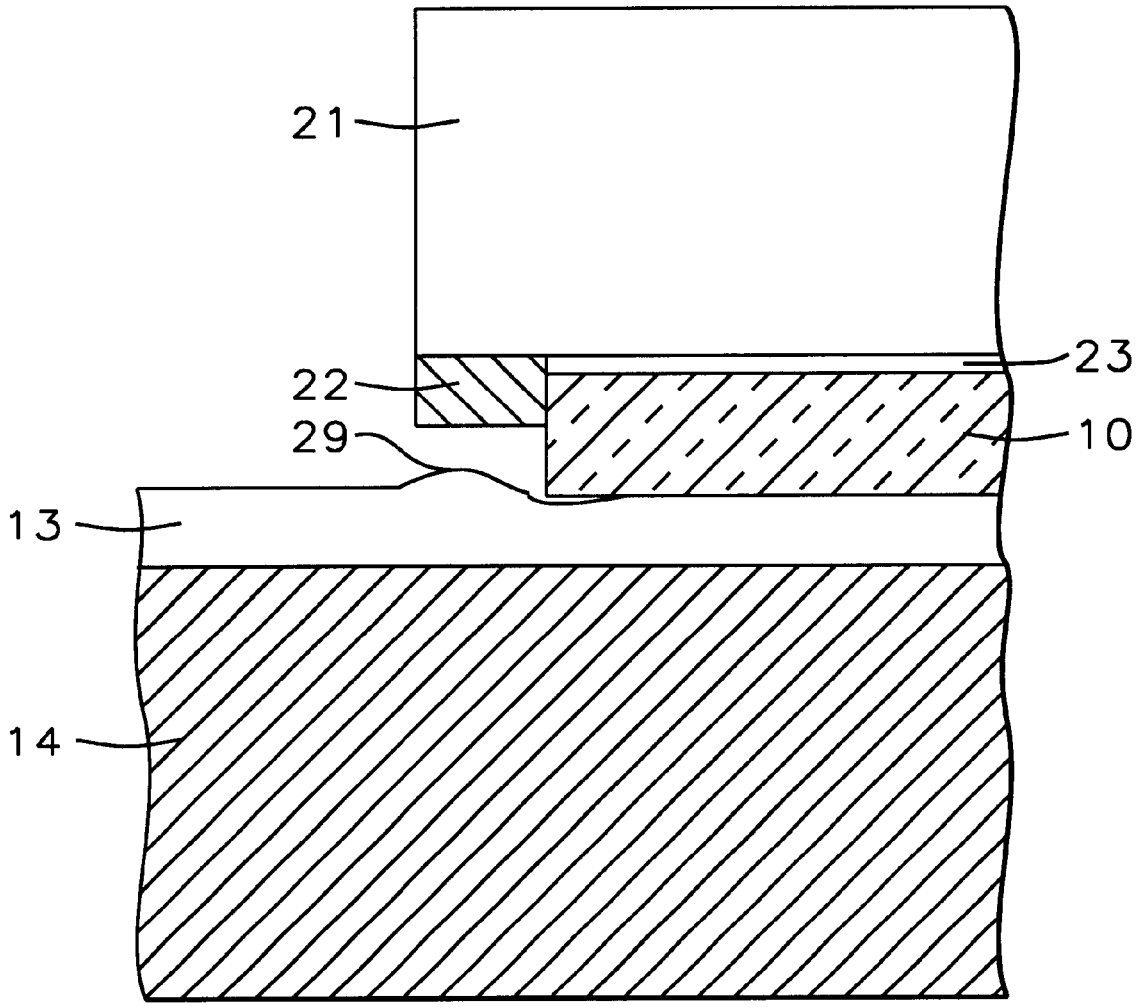
FIG. 2 is an enlarged fragmented view of a ripple in the polishing cloth of the prior art.

Referring now to FIGS. 1 and 2 there is shown a schematic of a conventional CMP tool according to the prior art which illustrates the arrangement of a chemical mechanical polishing pad used for planarization of a top surface topology of a semiconductor wafer.

The polishing pad 13, a porous material, is attached to the upper surface of a polishing platen 14. The polishing platen is horizontally supported by a platen rotating shaft 15, and is rotationally driven through the platen rotating shaft during the polishing operation.

A polishing head assembly 21 having a lower surface opposed to the upper surface of the polishing pad 13 on the polishing platen 14. The nesting surface is formed by a ring 22 and backing film 23 which releasably holds a wafer 10 to be polished. Generally, when loading the wafer, the wafer is held using a combination of vacuum suction and adhering means provided by the backing film 23 contacting the rear side of the wafer along with the retaining ring around the edge of the wafer that keeps the wafer centered on the polishing head. During polishing, a backside gas pressure is applied to the wafer, thusly improving its polished uniformity by pushing against the backside of the wafer. The polishing head assembly 21 is mounted to a rotating shaft 24 through a universal joint 25 and is driven through the rotating shaft 24.

The CMP tool polishes the wafer 10 which is positioned face down and in firm contact, under pressure, with the rotating polishing pad 13 which is mounted to a rigid platen 14. The wafer is also rotated either about an axis coincident with its own center or offset from its own center, but not coincident with the axis of rotation of the polishing pad 13. The abrasive polishing slurry 27 is dispensed to the pad surface through a nozzle 26. As a result of the rotating contact and abrasion between the polishing pad 13 and of a top layer of the wafer 10, oxide on the wafers top layer is removed thereby planarizing the wafer. The rate of removal is closely proportional to the pressure applied to the wafer 10. Furthermore, the rate of removal depends upon the topography of the top layer of wafer 10, as higher features (extending further from the wafer surface) are removed faster than lower features. Several techniques are presently used to assist in oxide removal, for example, maintaining a fresh supply of polishing slurry on the polishing surface of the polishing pad and, maintaining a uniform polishing texture on the surface of the polishing pad.

One known method of adjusting the oxide removal rate is by altering the surface state of the polishing pad 13. Without such dressing, or in the alternative, without repeatedly changing the polishing pad 13, the oxide removal rate would continue to fall as more wafers are polished, since the surface roughness tends to decrease and such roughness determines, in large part, the overall abrasiveness of the polishing pad 13 and slurry 27.

FIG. 1 shows a type of dressing wheel 30 of the prior art. The dressing wheel rotates under a controlled pressure and about its central axis to cover the annular track width generated by the wafer polishing. This operation is usually done between polishing of successive wafers.

The operation of a CMP polishing tool will now be described;

A semiconductor wafer 10 is retained within a nesting surface by cohesion with a backing film 23 applied to the under surface of polishing head assembly 21 , and by a backside vacuum pressure. During polishing, the polishing platen 14 and the polishing head assembly 21 are rotationally driven through the rotating shafts 15 and 24 by driving means (not shown). The polishing slurry 27 is supplied from the polishing slurry supply system 28 through the nozzle 26 onto the polishing pad 13. The wafer 10 held by the polishing head assembly 21 is rotated and pressed against the surface of a rotating polishing pad 13 under a controlled polishing pressure applied from pressurizing means (not shown). Since the polishing pad is a thin fabric pad, the vertical pressing force of the wafer tends to compress the pad thus forming a ripple 29 at the wafer's edge. This is best illustrated in FIG. 2. The ripple 29 impedes the polishing uniformity and removal of micro-scratches along the area bordering the outside edge of the wafer.

Figure 3:
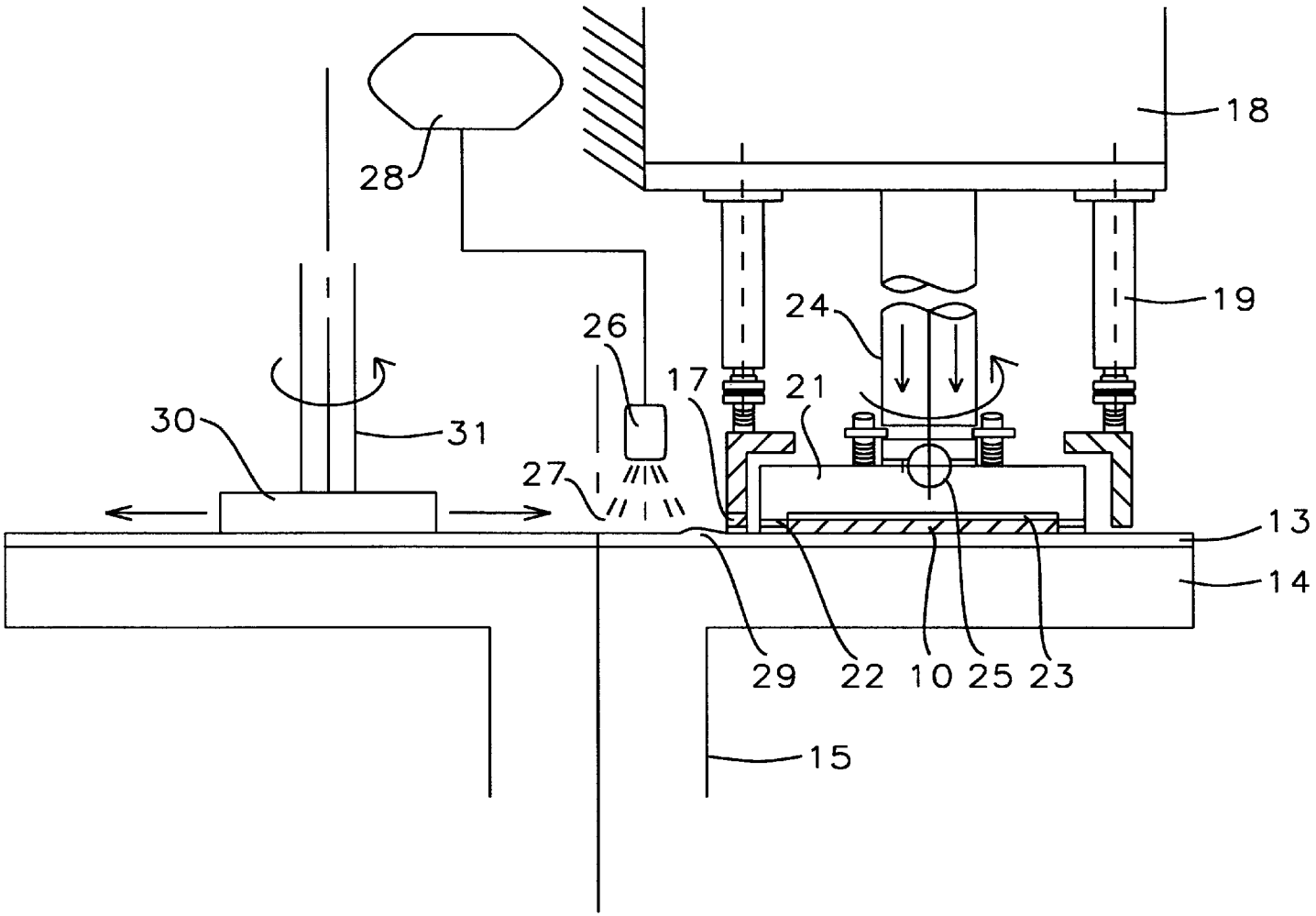
FIG. 3 is a schematic front view of a CMP apparatus with a fixed floating ring, according to the prior art.
Figure 4:
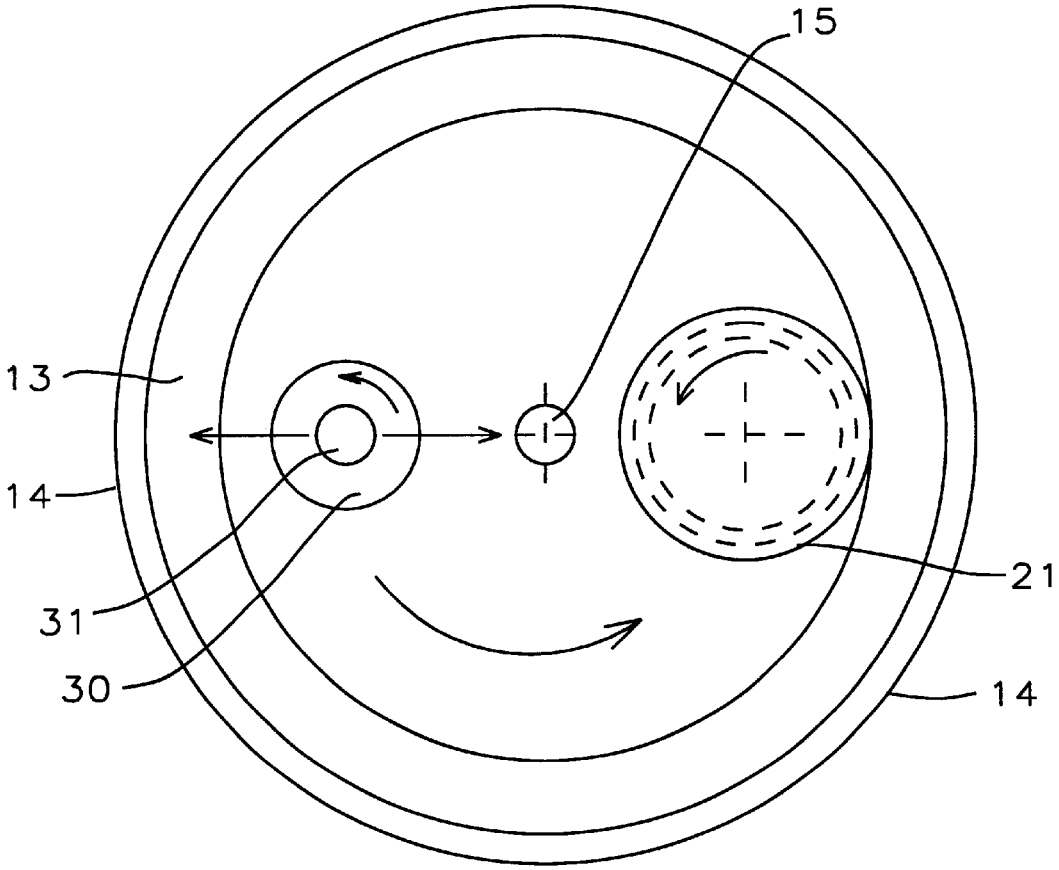
FIG. 4 is a schematic top view showing a positional relationship of a polishing cloth, wafer polishing head, and a dressing head of the prior art.

Referring also to FIGS. 3 and 4 which illustrate a prior art method for displacing the ripple 29 away from the periphery of the wafer. FIG. 3 shows a front view of a CMP apparatus with a cylindrical actuator assembly 19 mounted from the bottom surface of stationary motor housing 18. The cylindrical actuator assembly comprises a ring 17 mounted to the distal ends of several cylindrical actuators. The ring adjacently surrounds the rotatable polishing head assembly 21 without making contact. The cylindrical actuator assembly urges the ring 17 towards the plane of the polishing pad 13 by mechanical-pneumatic means. This vertical freedom permits the cylindrical actuator assembly to adjust without impeding the polishing pressure applied to the wafer, while simultaneously transforming the ripple to the outside of ring 17. The ring is a sacrificial wearing member which is easily replaced. The polished surface of the wafer 10 is burnished by a fresh supply of a polishing slurry containing a mechanical granular silica. The stationary ring however, tends to scrape the polishing slurry from the rotating polishing pad thus accumulating slurry at the outside periphery of the ring, the amount accumulated depends on the applied downward force of ring 17. This action impedes the polishing process thus prolonging the polishing cycle.

There will now be described in detail with reference to the drawings some preferred embodiments of the present invention applied to a chemical mechanical polishing tool for planarizing of a semiconductor wafer. In the following description of the preferred embodiments, the same reference numerals as those in the prior art denote similar parts for convenience of illustration.

Referring still to FIGS. 3 and 4 which illustrate the prior art CMP polishing apparatus used for polishing a semiconductor wafer 10 and the method for displacing the ripple 29 away from the periphery of the wafer. FIG. 3 showing a front view of a CMP apparatus with a cylindrical actuator assembly 19 mounted to the bottom surface of a stationary motor housing 18. The cylindrical actuator assembly comprises a ring 17 mounted to the distal ends of several cylindrical actuators, the ring 17 adjacently surrounds the rotatable polishing head assembly 21 without making physical contact with it. The cylindrical actuators urges the ring 17 towards the plane of the polishing pad 13 using mechanical-pneumatic means. The vertical displacement of the cylindrical actuator assembly vertically adjust itself without impeding the pressure applied to the wafer while simultaneously transforming the ripple to the outside of the cylindrical housing area.

Figure 5:
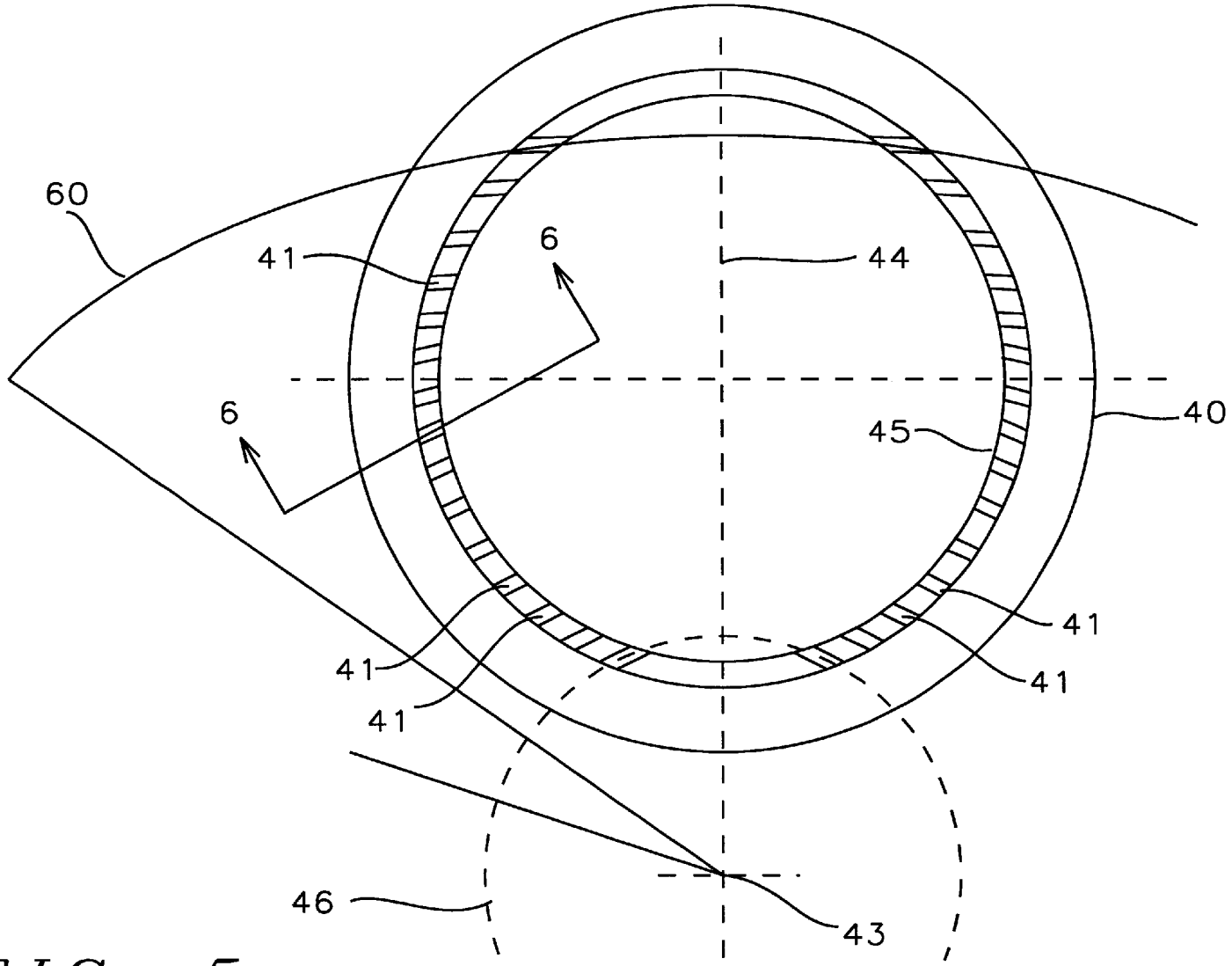
FIG. 5 shows a bottom view of a floatable ditch type ring, of the invention.
Figure 6:
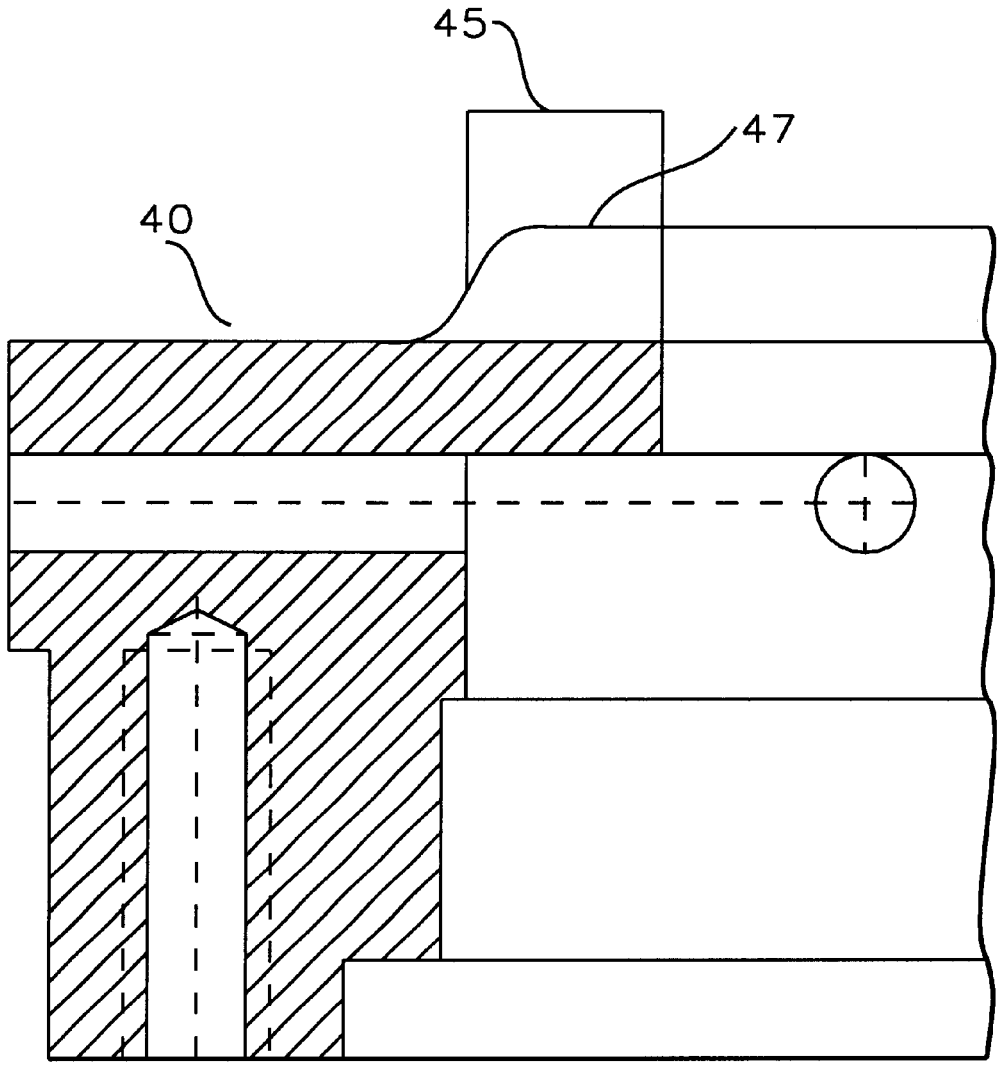
FIG. 6 is an enlarged cross-sectional view of the floatable ditch-type ring of the invention.
Figure 7:
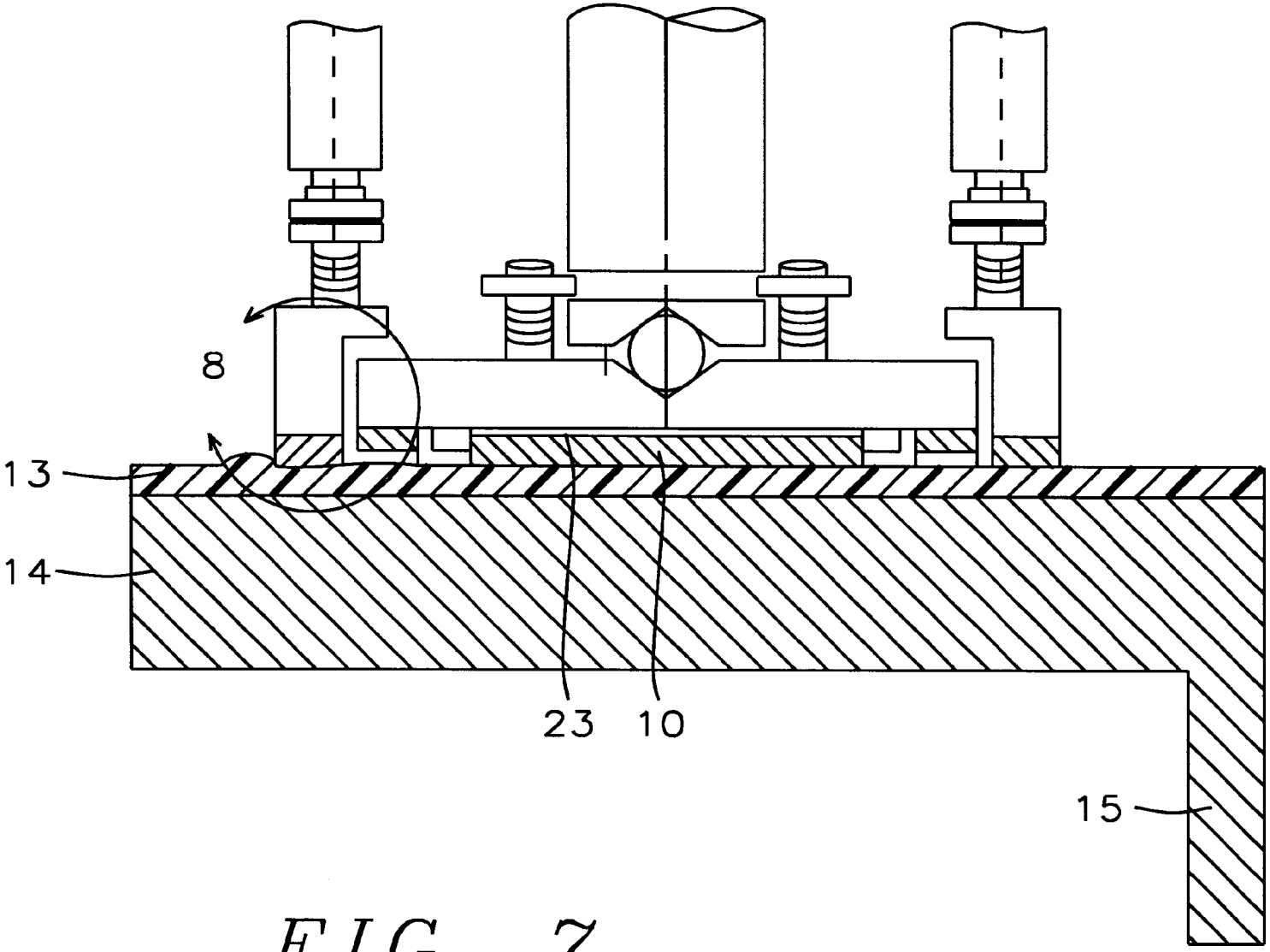
FIG. 7 is a partial front section view of the invention as related to the CMP polishing pad.
Figure 8:
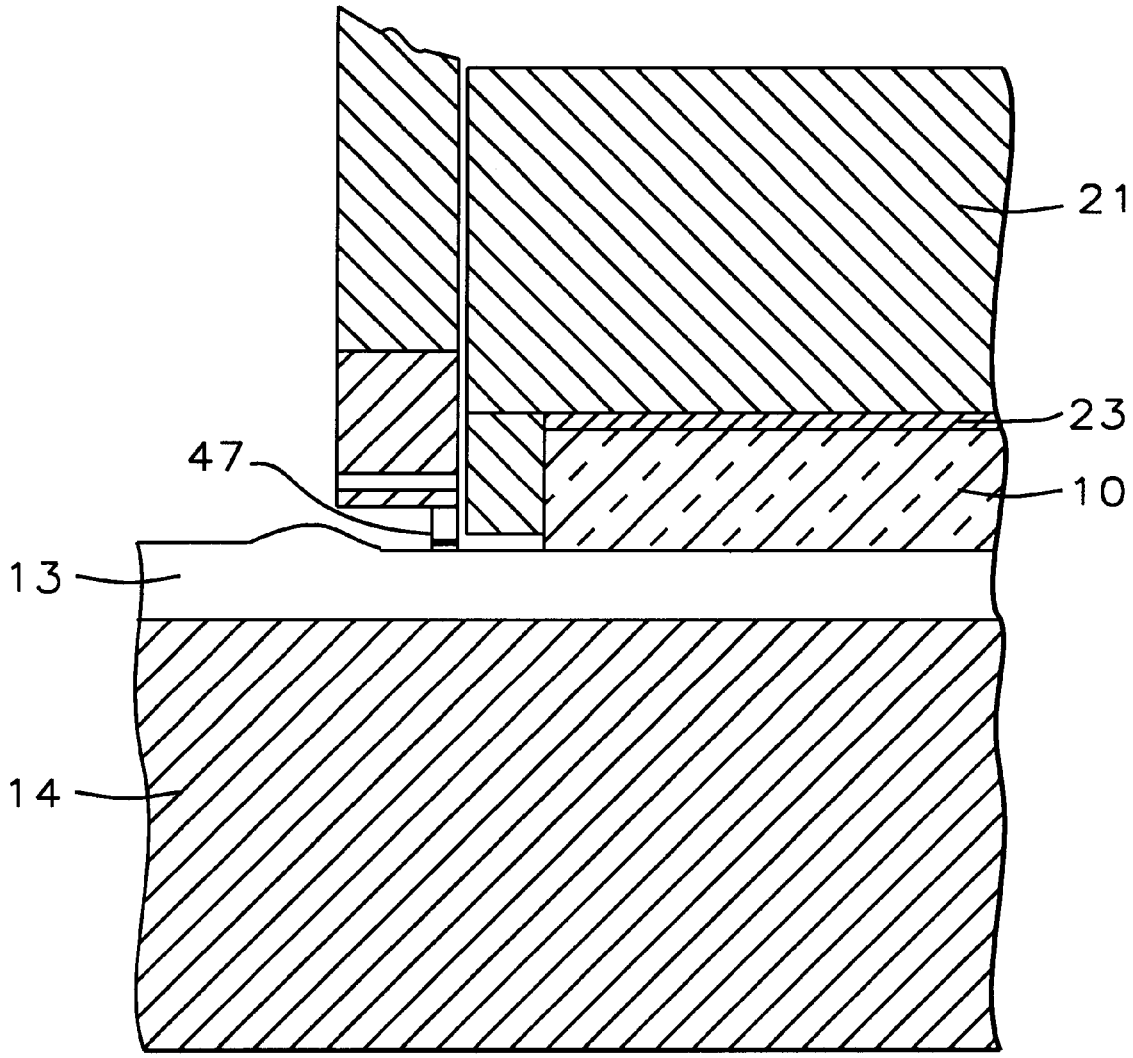
FIG. 8 a partial exploded cross-section view of FIG. 7 as related to the CMP polishing pad.
Figure 9:
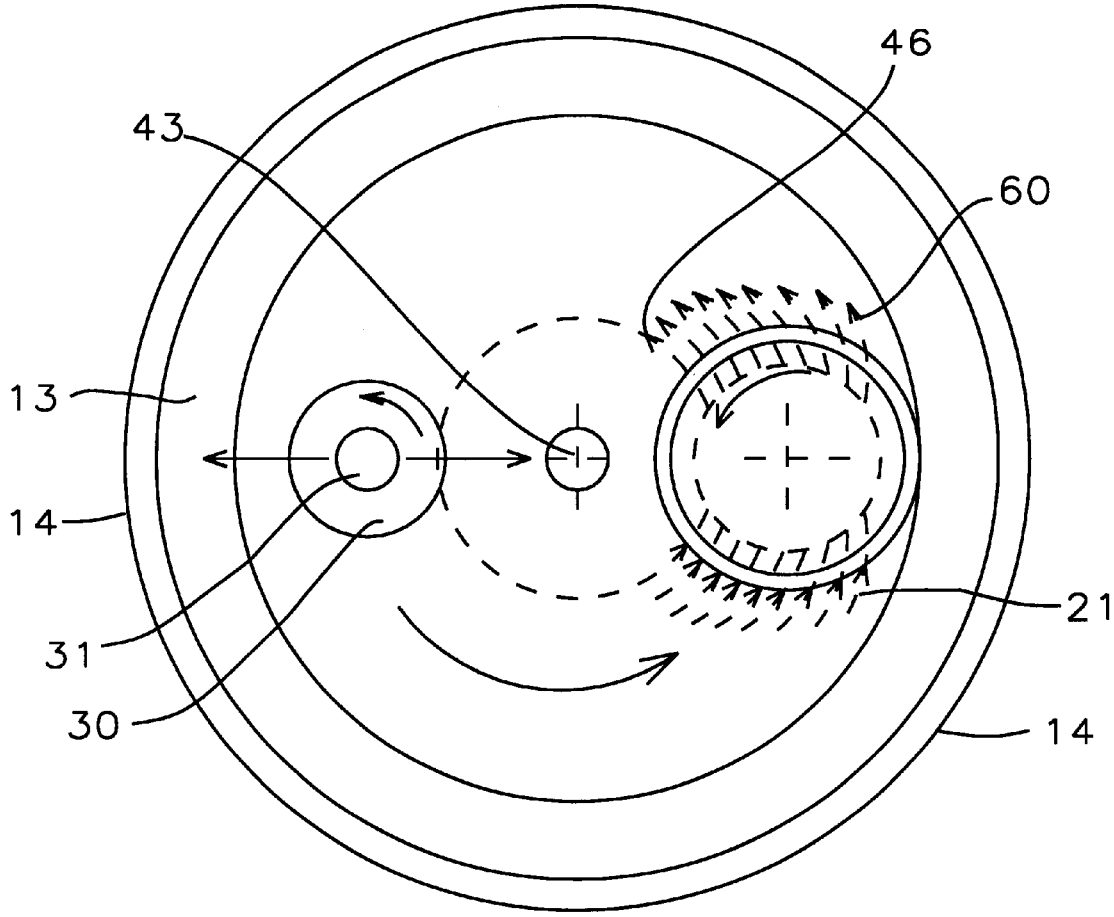
FIG. 9 is a schematic plan view showing the slurry flow pattern through radial grooves in the ditch type ring of the invention.

Referring now to FIGS. 5 through 9 showing the improvements of the invention. A ditched ring 40 replaces sacrificial ring 17, as illustrated in FIG. 3 of the prior art, and in FIG. 7 and 8 of the invention. The ditched ring 40 is mounted to the underside of cylindrical housing 19 in the same manner as sacrificial ring 17 and is easily replaceable. FIG. 5 shows the ditched ring 40 having a multiplicity of conduit grooves 41 formed in pairs, as each conduit pair is coequally formed at each side of a center axis 44 at radial positions defined by a multiplicity of radii, as examples, radii 46 through 60. The radially formed conduits 41 having a common center 43 are shaped to form the conduit grooves in annular member 45. Common center 43 is also the center of rotation of the polishing platen 14 driven by rotating shaft 15. Referring also to FIG. 6 illustrating an enlarged cross-section of ditched ring 40 showing annular member 45 being of a reduced wall thickness. Surface 47 of annular member 45 makes sacrificial contact with rotating polishing pad 13. Slurry contained on the rotating polishing pad flows through the conduit grooves in ditched ring 40 forming an annular ring pattern of slurry traveling towards the spinning wafer at unimpeded radial surface speeds. This is best illustrated in FIG. 9. Because of the common center 43 used for forming the radial conduits in annular member 45 and the center of polishing pad rotation tends to average and control the boundary layer of slurry available to the wafer. It has been established, by way of experiment and measurement, that this controlled metering of slurry through radially formed conduits improves the quality of CMP planarization and more specifically uniformity in removing micro-scratches.

Figure 10:
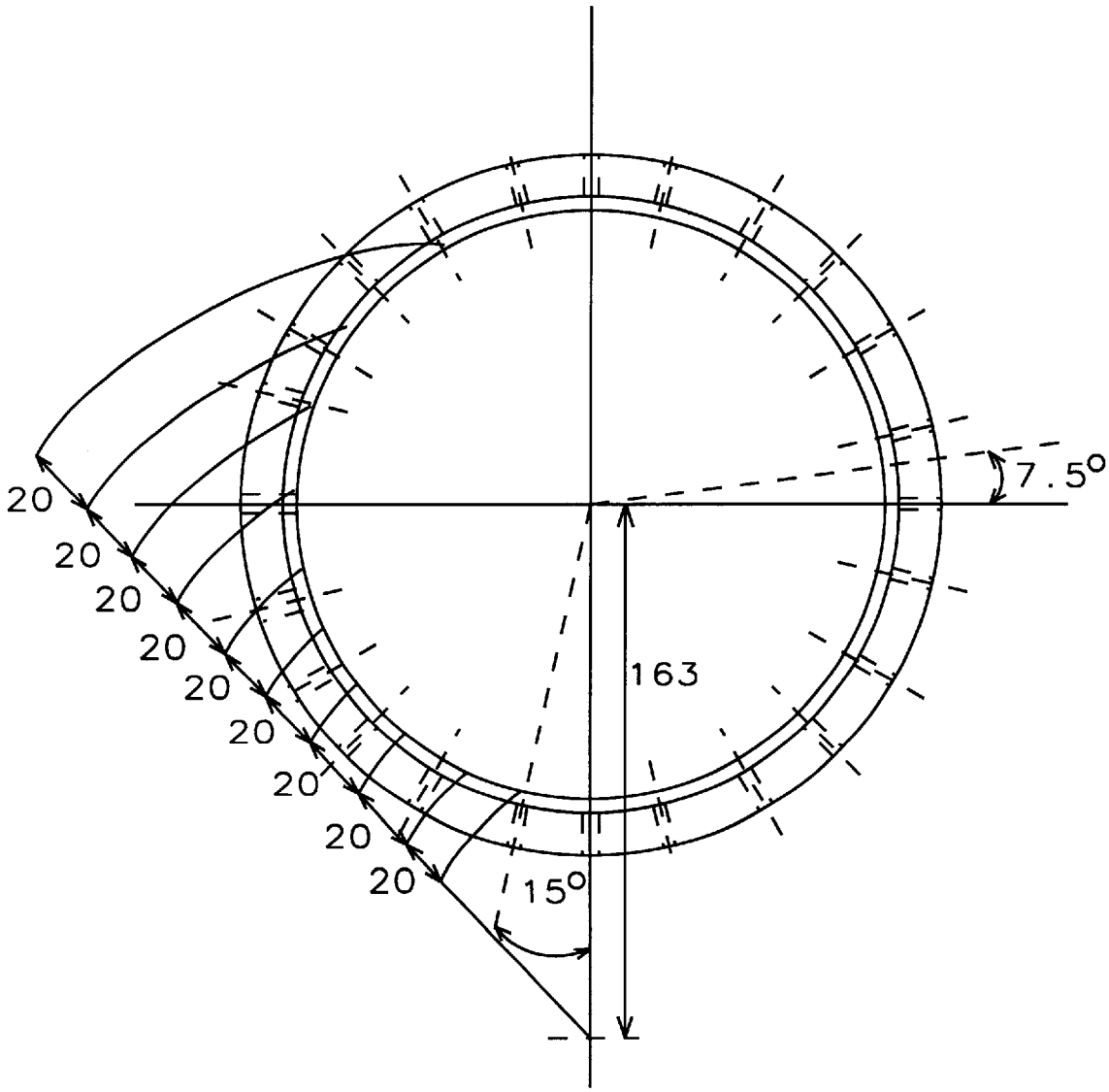
FIG. 10 is an enlarged detailed view of the floatable ditch-type ring of the invention.

FIG. 10 illustrates a detailed ditched ring 40, with dimensions, of the type used to show operability and to extract actual measurement data.

In summary, an apparatus for polishing a semiconductor wafer including a rotatable polishing platen having an upper surface, a polishing pad fixedly attached to the upper surface, a polishing slurry containing a mechanical abrasive deposited on the upper surface of the polishing pad. Mounted above the polishing pad is a rotatable polishing head assembly having a shallow recessed face adapted to centrally hold the upper back edge of the substrate, the recessed face is oriented substantially parallel to the upper surface of polishing platen. The rotatable polishing head assembly has its rotatable axis offset relative to the rotatable axis of the polishing platen. A non-rotatable cylindrical actuator assembly is coaxially oriented about the outer edge of the rotatable polishing head assembly with a ditched ring removably attached to the bottom surface of the fixed cylindrical ring. The ditched ring with a bottom section of a reduced wall thickness of approximately 5 mm. A multiplicity of conduit grooves are formed in the bottom section of the ditched ring that allows a boundary layer of abrasive slurry to travel unimpeded to the rotating semiconductor wafer. the conduit grooves formed in pairs, each groove formed on either side of the center coordinate axis of the ditched ring. The conduit grooves pairs are radially concentric and projected from a point outside of the ditched ring on its center axis. The center coordinate axis of these conduit grooves is coincident with the rotatable axis of the polishing platen.

The reduced wall thickness at the bottom of the ditched ring is configured to displace wrinkles from the outer edge of the wafer to the outer periphery of the ditched ring. This solves the edge exclusion problem, while the concentric conduit grooves allow unimpeded tracks of abrasive slurry to uniformly remove microscratches from the planarized surface of the wafer While the invention has been particularly shown and described with reference to the preferred embodiments thereof, it will be understood by those skilled in the art that various changes in form and details may be made without departing from the spirit and scope of the invention.

What is claimed is:

1. A method for polishing a semiconductor wafer comprising the steps of:

providing a chemical mechanical polishing apparatus having a rotary polishing platen with a polishing pad fixedly attached to its upper surface, and a polishing slurry containing a mechanical abrasive dispensed on said upper surface of said polishing pad, and a rotary polishing head assembly having a shallow recessed face adapted to centrally hold the upper back edge of said semiconductor wafer, said recessed face is oriented substantially parallel to said upper surface of said polishing platen;

said rotatable polishing head assembly positionally offset relative to said rotating polishing platen, and providing a non-rotary cylindrical actuator assembly having a bottom surface that is coaxially oriented about an outer edge of said polishing head assembly;

removably attaching a ditched ring to the bottom surface of said cylindrical actuator assembly.

2. The method of claim 1, wherein said cylindrical actuator assembly is vertically floatable with respect to said polishing head assembly.

3. The method of claim 1, wherein said ditched ring further comprises:

a bottom section of a reduced wall thickness of approximately 5 mm;

a multiplicity of conduit grooves formed in said bottom section of ditched ring permitting a boundary layer of abrasive slurry to travel unimpeded to a rotating semiconductor wafer;

said conduit grooves formed in pairs, each groove formed on either side of a center coordinate axis of said ditched ring;

said conduit grooves pairs are radially concentric and developed from a point outside of said ditched ring on said center axis;

said center coordinate axis of said conduit grooves is coincident with rotatable axis of the polishing platen.

4. The method of claim 3 wherein said conduit grooves are substantially 0.4 mm wide.

5. The method of claim 3 wherein said conduit grooves are radially concentric with a spacing between of approximately 20 mm.

6. The method of claim 1 wherein said reduced wall thickness at the bottom of said ditched ring is configured to displace wrinkles from the outer edge of said semiconductor wafer to the outer periphery of the ditched ring.

7. The method of claim 1 wherein the use of said ditched ring during chemical mechanical polishing of wafers uniformly removes microscratches.

* * * * *